US005860755A

United States Patent [19]

Bunk

[11] Patent Number: 5,860,755

[45] Date of Patent: Jan. 19, 1999

[54] LIPSTICK HOLDER WITH MIRROR

[76] Inventor: Carole Bunk, 455 Olde Bridge Rd. #A-1, Bensalem, Pa. 19020

[21] Appl. No.: 823,335

[22] Filed: Mar. 24, 1997

[51] Int. Cl.[6] ..... B43K 25/00

[52] U.S. Cl. ..... 401/52; 401/126; 132/316; 132/318

[58] Field of Search ..... 401/52, 126, 195, 401/DIG. 1; 132/316, 318

[56] References Cited

U.S. PATENT DOCUMENTS

| | | | |
|---|---|---|---|
| 2,294,257 | 8/1942 | Udvarhely | 132/318 |
| 2,650,597 | 9/1953 | Girard | 132/316 |
| 3,123,661 | 3/1964 | Roman | 132/316 |
| 3,729,011 | 4/1973 | Gleicher | 401/200 |
| 3,871,390 | 3/1975 | Spatz | 401/126 |
| 5,715,961 | 2/1998 | Robertson | 132/318 |

*Primary Examiner*—David J. Walczak

[57] ABSTRACT

A lipstick holder with mirror including a cylindrical housing member that has a base member with an extension tube. Included is a cylindrical cap member that is sized for removable positioning over the extension tube of the cylindrical housing. Lastly, included is a reflective member having a disk-like shape for rotatably coupling to the end wall of the cylindrical cap member.

6 Claims, 2 Drawing Sheets

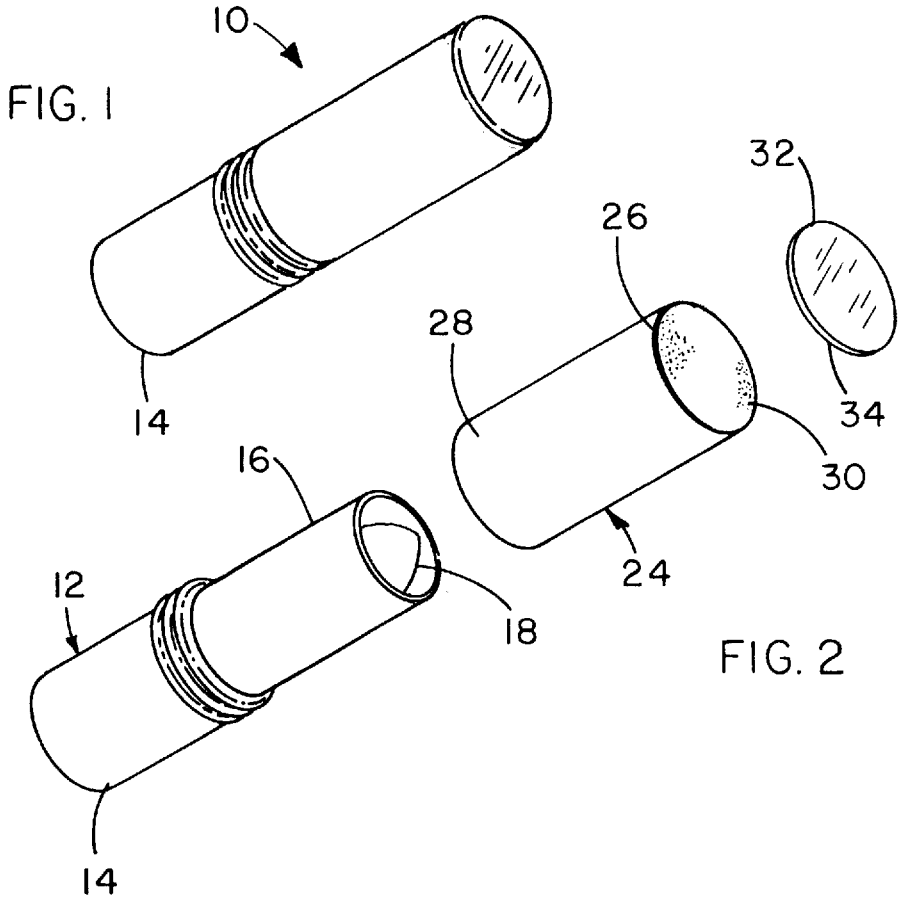
FIG. 1
FIG. 2
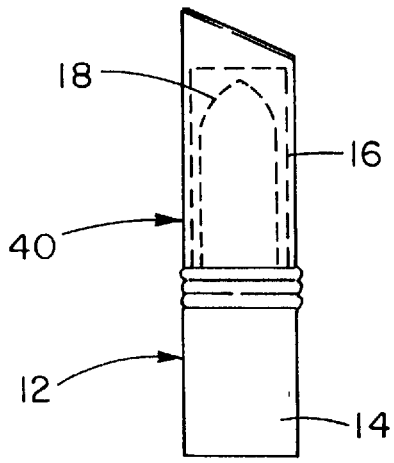
FIG. 3
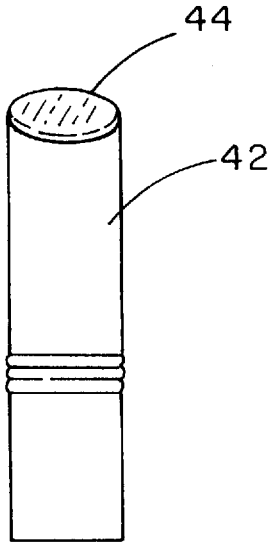
FIG. 4

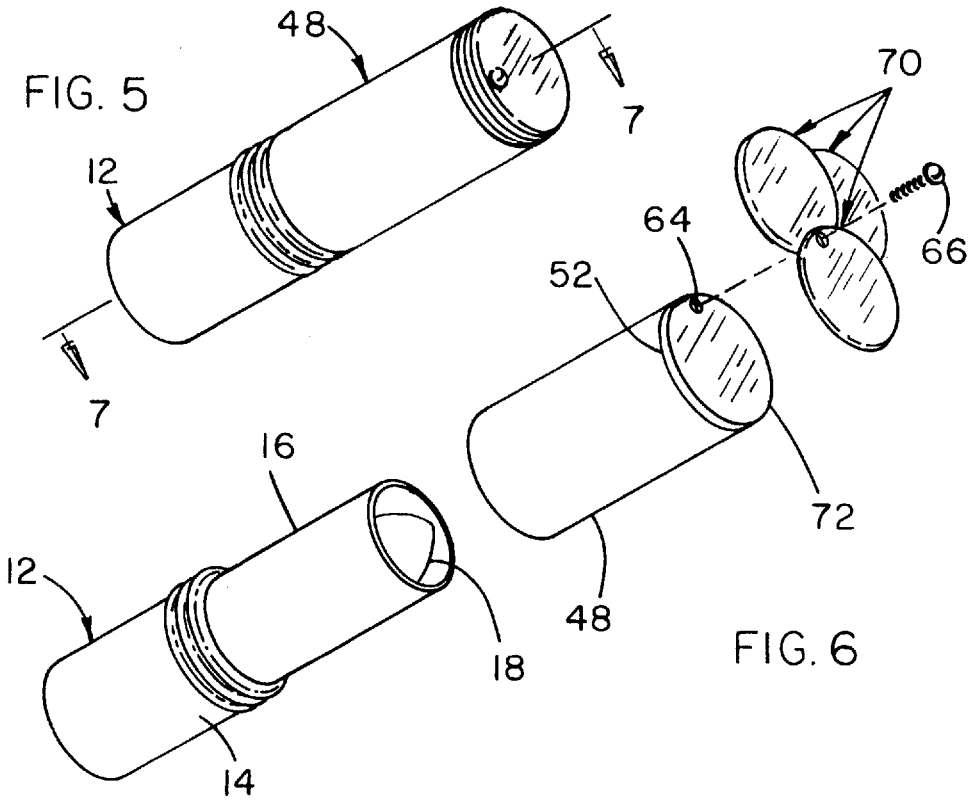
FIG. 5
FIG. 6
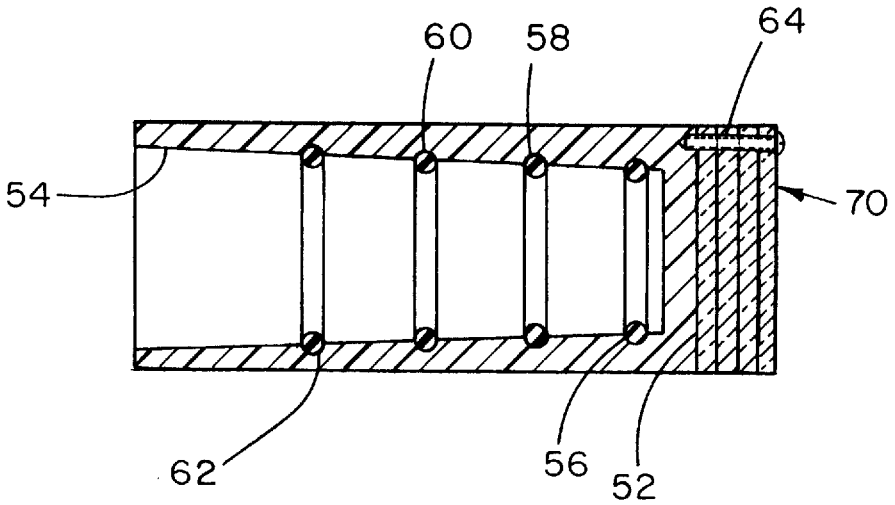
FIG. 7

LIPSTICK HOLDER WITH MIRROR

BACKGROUND OF THE INVENTION

1. Field of the Invention

The present invention relates to a lipstick holder with mirror and more particularly pertains to providing a lipstick container with a cover that has a reflective member attached to an end wall, the reflective member further allowing the lipstick use to view their lips when applying lipstick.

2. Description of the Prior Art

The use of a mirror is known in the prior art. More specifically, mirrors heretofore devised and utilized for the purpose of providing lipstick holders with a reflective member are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. Des. 354,373 to Khoury discloses a combined lipstick case, mirror and cosmetic applicators. U.S. Pat. No. 5,257,696 to Greene disclosed a mirrored lipstick container. U.S. Pat. No. 5,178,478 to Ryder discloses a combined lipstick holder and lip brush case with a mirror and clip. U.S. Pat. No. 4,905,128 to Caires discloses a lipstick application assisting device. U.S. Pat. No. 4,326,546 to Acker discloses a combination lipstick display and storage container. Lastly, U.S. Pat. Des. 243,124 to Horowitz discloses a combined lipstick holder and mirror.

In this respect, the lipstick holder with mirror according to the present invention substantially departs from the conventional concepts and designs of the prior art, and in so doing provides an apparatus primarily developed for the purpose of providing a lipstick container with a cover that has a reflective member attached to an end wall, the reflective member further allowing the lipstick use to view their lips when applying lipstick.

Therefore, it can be appreciated that there exists a continuing need for a new and improved lipstick holder with mirror which can be used for providing a lipstick container with a cover that has a reflective member attached to an end wall, the reflective member further allowing the lipstick use to view their lips when applying lipstick. In this regard, the present invention substantially fulfills this need.

SUMMARY OF THE INVENTION

In view of the foregoing disadvantages inherent in the known types of mirrors now present in the prior art, the present invention provides an improved lipstick holder with mirror. As such, the general purpose of the present invention, which will be described subsequently in greater detail, is to provide a new and improved lipstick holder with mirror which has all the advantages of the prior art and none of the disadvantages.

To attain this, the present invention essentially comprises a cylindrical housing member that has a base member with an extension tube projecting therefrom. The cylindrical housing has a lipstick member within. The lipstick member is extended and retracted within the cylindrical housing relative to the extension tube. A cylindrical cap member is included and sized for removable positioning over the extension tube of the cylindrical housing. The cylindrical cap member has an end wall with an adhesive thereon. Lastly, a reflective member has a disk-like shape for fixedly attaching to the end wall of the cylindrical cap member. The cylindrical cap member is removed from the cylindrical housing for application of the lipstick. The reflective member provides a reflective surface for assisting with the application of the lipstick.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lipstick holder with mirror which has all the advantages of the prior art mirrors and none of the disadvantages.

It is another object of the present invention to provide a new and improved lipstick holder with mirror which may be easily and efficiently manufactured and marketed.

It is a further object of the present invention to provide a new and improved lipstick holder with mirror which is of a durable and reliable construction.

An even further object of the present invention is to provide a new and improved lipstick holder with mirror which is susceptible of a low cost of manufacture with regard to both materials and labor, and which accordingly is then susceptible of low prices of sale to the consuming public, thereby making such lipstick holder with mirror economically available to the buying public.

Still yet another object of the present invention is to provide a new and improved lipstick holder with mirror which provides in the apparatuses and methods of the prior art some of the advantages thereof, while simultaneously overcoming some of the disadvantages normally associated therewith.

Still another object of the present invention is to providing a lipstick container with a cover that has a reflective member attached to an end wall, the reflective member further allowing the lipstick use to view their lips when applying lipstick.

Lastly, it is an object of the present invention to provide a new and improved a cylindrical housing member that has a base member with an extension tube. Included is a cylindrical cap member that is sized for removable positioning over the extension tube of the cylindrical housing. Lastly, included is a reflective member having a disk-like shape for rotatably coupling to the end wall of the cylindrical cap member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the lipstick holder with mirror constructed in accordance with the principles of the present invention.

FIG. 2 is an exploded view of the operable components of the lipstick holder of FIG. 1.

FIG. 3 is side elevational view of the lipstick holder with an tapered extension tube.

FIG. 4 is a frontal view of the lipstick holder of FIG. 3.

FIG. 5 is perspective illustration of another embodiment of the lipstick holder with mirror constructed in accordance with the principles of the present invention.

FIG. 6 is an exploded view showing the operable components of the lipstick holder of FIG. 5.

FIG. 7 is a cross-sectional view of the cylindrical housing member of the lipstick holder taken along line 7—7 of FIG. 5.

Similar reference characters refer to similar parts throughout the several views of the drawings.

DESCRIPTION OF THE PREFERRED EMBODIMENT

With reference now to the drawings, and in particular to FIG. 1 thereof, a new and improved lipstick holder with mirror embodying the principles and concepts of the present invention and generally designated by the reference numeral 10 will be described.

The present invention, the new and improved lipstick holder with mirror, is comprised of a plurality of components. Such components in their broadest context include a cylindrical member, a cap and a reflective member. Such components are individually configured and correlated with respect to each other so as to attain the desired objective.

More specifically, it will be noted that the lipstick holder with mirror has three embodiments. In the first embodiment includes a cylindrical housing member 12. The cylindrical housing member has a base member 14 with an extension tube 16 projecting therefrom. As seen in FIG. 2, the cylindrical housing having a lipstick member 18 within. The lipstick member is extended and retracted within the cylindrical housing relative to the extension tube. The base member has a diameter greater than the diameter of the extension tube.

Included is a cylindrical cap member 24. The cylindrical cap member is sized for removable positioning over the extension tube 16 of the cylindrical housing. The cylindrical cap member has an end wall 26 and an outer wall 28. The end wall has an adhesive 30. The cylindrical cap member, when positioned over the extension tube, is coaxially aligned with the base member.

Lastly, a reflective member 32 is provided. As seen in FIG. 2, the reflective member has a disk-like shape for fixedly attaching to the end wall of the cylindrical cap member 24. The reflective member has a peripheral edge 34 that is flush with the outer wall 28 of the cap member, when the reflective member is attached. The cylindrical cap member is removed from the cylindrical housing for application of the lipstick, and the reflective member provides a reflective surface for assisting with the application of the lipstick.

An alternative a cylindrical cap member 40 is provided for the second embodiment. This cap member is also sized for removable positioning over the extension tube 16 of the cylindrical housing 12. The cylindrical cap member has a tapered end wall 42 as shown FIGS. 3 and 4. The tapered end wall has an adhesive that is identical to the adhesive 30 of FIG. 2.

A reflective member 44 is provided for the tapered end wall of the alternative cap member. As seen in FIG. 4, the reflective member has an oval shape and is fixedly attached to the end wall of the cap member. The oval shape of the reflective member provides more reflective surface than that of the reflective member of FIG. 2. The cylindrical cap member is removed from the cylindrical housing for application of the lipstick, with the reflective member providing a reflective surface for assisting with the application of the lipstick.

Furthermore, the third embodiment of the lipstick holder with mirror has another cylindrical cap member 48. This cylindrical cap member is sized for removable positioning over the extension tube 16 of the cylindrical housing 12. As seen in FIG. 7, this cylindrical cap member 48 has an end wall 52 and an interior wall 54. The interior wall has a plurality of O-rings 56, 58, 60, and 62. The O-rings are mounted to the interior wall and are proportionately spaced one from another. A first O-ring 56 is spaced from the interior side of the end wall. The plurality of O-rings increase in diameter. The last O-ring 62 has the greatest diameter. This cylindrical cap member allows the cap member to removably engage the extension tube of most lipstick holders. As illustrated the end wall 52 of the cylindrical cap, of the third embodiment, has a threaded opening 64 for receiving a screw 66.

Included is an alternative a reflective member 70. This reflective member is a plurality of reflective disks coupled to the end wall with the screw 66. As shown in FIG. 6, the plurality of reflective disk are rotated about the screw for providing a petal-like reflective surface that has at least four petals 72. The petal-like reflective surface give the lipstick user a greater reflective area to view their lip on during the application process. Finally, the reflective member is either glass or a reflective material.

The present invention lipstick holder with mirror assist in the application of lipstick by providing a reflective surface for viewing the lips. The mirror attached to the end wall of the cap member of each of the three embodiments eliminates the blind application of lipstick.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lipstick holder with mirror comprising:

a cylindrical housing member having a base member with an extension tube projecting therefrom, the cylindrical housing having a lipstick member therein, the lipstick member being extended and retracted within the cylindrical housing relative to the extension tube;

a cylindrical cap member being sized for removable positioning over the extension tube of the cylindrical housing, the cylindrical cap member having a tapered end wall with an adhesive thereon; and a reflective member having an oval shape for fixedly attaching to the end wall of the cylindrical cap member, the cylindrical cap member being removed from the cylindrical housing for application of the lipstick, with the reflective member providing a reflective surface for assisting with the application of the lipstick.

2. A lipstick holder with mirror comprising:

a cylindrical housing member having a base member with an extension tube projecting therefrom, a quantity of lipstick stored within the extension tube;

a cylindrical cap member being sized for removable positioning over the extension tube of the cylindrical housing, the cylindrical cap having an end wall; and a reflective member having a disk-like shape for rotatably coupling to the end wall of the cylindrical cap member wherein the cylindrical cap member has an end wall and an interior wall, the interior wall having a plurality of O-rings mounted thereto and proportionately spaced one from another; and wherein the end wall has a threaded opening for receiving a screw.

3. The lipstick holder with mirror as set forth in claim 2, wherein the cylindrical housing having a lipstick member therein, and the lipstick member being extended and retracted within the cylindrical housing relative to the extension tube.

4. The lipstick holder with mirror as set forth in claim 2, wherein the reflective member being a plurality of reflective disks coupled to the end wall by a screw, the plurality of reflective disks being rotated about the screw for providing a petal-like reflective surface.

5. The lipstick holder with mirror as set forth in claim 2, wherein the cylindrical cap member being removed from the cylindrical housing for application of the lipstick, with the reflective member providing a reflective surface for assisting with the application of the lipstick.

6. A lipstick holder with mirror comprising:

a cylindrical housing member having a base member with an extension tube projecting therefrom, a quantity of lipstick stored within the extension tube;

a cylindrical cap member being sized for removable positioning over the extension tube of the cylindrical housing, the cylindrical cap having an end wall; and a reflective member having a disk-like shape for rotatably coupling to the end wall of the cylindrical cap member;

wherein the cylindrical cap member having an end wall and an interior wall, the interior wall having a plurality of O-rings mounted thereto and proportionately spaced one from another; and wherein the end wall having a threaded opening for receiving a screw; and wherein the cylindrical housing having a lipstick member therein, and the lipstick member being extended and retracted within the cylindrical housing relative to the extension tube; and wherein the reflective member is formed from a plurality of reflective disks coupled to the end wall by a screw, the plurality of reflective disks being rotated about the screw for providing a petal-like reflective surface.

* * * * *